United States Patent [19]

Keckman

[11] 4,296,578

[45] Oct. 27, 1981

[54] SKYLIGHT APPARATUS

[76] Inventor: Heikki Keckman, It.Harjutie 11, 07900 Loviisa, Finland

[21] Appl. No.: 47,867

[22] Filed: Jun. 12, 1979

[30] Foreign Application Priority Data

| | | | |
|---|---|---|---|
| Jun. 13, 1978 | [FI] | Finland | 780690 |
| Jun. 13, 1978 | [FI] | Finland | 781893 |
| Oct. 20, 1978 | [FI] | Finland | 783238 |

[51] Int. Cl.[3] ..... E04B 7/18

[52] U.S. Cl. ..... 52/200; 52/788

[58] Field of Search ..... 52/200, 788

[56] References Cited

U.S. PATENT DOCUMENTS

| | | | |
|---|---|---|---|
| 3,127,699 | 4/1964 | Wasserman | 52/200 X |
| 3,417,527 | 12/1968 | Kietchaefer | 52/200 |
| 3,996,844 | 12/1976 | Leurent | 52/200 X |

FOREIGN PATENT DOCUMENTS

| | | | |
|---|---|---|---|
| 1260753 | 2/1968 | Fed. Rep. of Germany | 52/200 |
| 2457110 | 6/1975 | Fed. Rep. of Germany | 52/200 |
| 1269537 | 3/1964 | France | 52/200 |
| 1477844 | 3/1967 | France | 52/200 |

*Primary Examiner*—Carl D. Friedman

*Attorney, Agent, or Firm*—Steinberg & Raskin

[57] ABSTRACT

Skylight apparatus comprising at least two light-transmitting dome-shaped window elements and frame structure located within the skylight aperture in which the window elements are mounted. The window elements include peripherally extending outer support edge portions and the frame structure is constructed in a manner such that the mutual spacing between regions adjacent to the peripherally extending outer support edge portions of vertically adjacent window elements is substantially equal to the mutual spacing between the central portions thereof. In this manner, the thermal insulation capacity of the skylight apparatus is significantly improved.

14 Claims, 16 Drawing Figures

SKYLIGHT APPARATUS

BACKGROUND OF THE INVENTION

This invention relates generally to skylight apparatus and, more particularly, to a skylight apparatus which has a thermal insulation capacity which is significantly greater than is presently available in conventional skylight apparatus.

One of the disadvantages which conventional skylight apparatus presents is the relatively large extent of leakage of thermal energy which takes place through the marginal areas thereof. Thus, for example, in skylights of the dome type, i.e., where the skylight window element has a dome-shaped portion, the spacing between the window elements is insignificant at their marginal or peripheral areas. By virtue of this fact, the thermal insulating capacity of the skylight apparatus at these marginal areas is virtually non-existent. The fact that a high thermal insulative capacity usually exists at the central portions of the window elements obtains a secondary importance when the insignificant thermal insulative capacity at the marginal regions is considered.

Although there is known in the prior art skylight apparatus wherein the marginal areas of vertically adjacent window elements are mutually spaced from each other, such prior art apparatus does not solve the thermal insulation problem discussed above. More particularly, skylight apparatus is disclosed in German publicizing print No. 1,260,753 wherein window element supporting members are provided having opposed portions the distance between which decrease in the downward direction and wherein two window elements of different size are supported thereby. In this structure, the supporting members are defined by the marginal areas of the skylight aperture and the vertically adjacent window elements have marginal areas which are mutually spaced from each other for the primary reason of preventing the formation of condensate. As mentioned above, however, such known apparatus does not solve the problem of heat loss through the marginal areas of the skylight apparatus.

SUMMARY OF THE INVENTION

Accordingly, one object of the present invention is to provide new and improved skylight apparatus wherein the thermal insulation capacity is significantly improved relative to conventional skylight apparatus especially in the marginal regions of the window elements.

Another object of the present invention is to provide such a new and improved skylight apparatus wherein the improved thermal insulation is obtained without the necessity of additional thermal lagging.

Still another object of the present invention is to provide such a new and improved skylight apparatus which can be assembled in its entirety in the factory so that an extremely reliable seal between adjacent window elements can be achieved. Such seals are difficult if not impossible to achieve when the skylight apparatus is assembled at the building site. In this connection, it is practically impossible to assemble skylight apparatus at the building site under adverse weather conditions, such as during the winter, and maintain the apparatus in a clean condition with the desired tight sealing condition.

It is still another object of the present invention to provide such a new and improved skylight apparatus which can be easily and rapidly assembled and which can be adapted for improving the thermal insulation capacity of existing skylight apparatus.

Briefly, in accordance with the present invention, these and other objects are obtained by providing skylight apparatus including at least two dome-shaped window elements which are so located that the marginal or peripheral areas of a pair of vertically adjacent ones of the window elements are spaced a distance which is substantially equal to the spacing of the central portions of these window elements. Further, according to the present invention, the space between the lowermost window element and the next vertically adjacent window element is located within the aperture defining edge surfaces.

More particularly, in one embodiment of the invention, a frame structure is provided which defines a plurality of vertically spaced supporting portions, each of which is smaller in peripheral extent than the supporting portion which is located vertically thereabove. In this embodiment, a plurality of vertically spaced window elements are provided, each having a dimension which varies relative to the other ones of the window elements, the window elements being mounted at peripheral edge support portions on corresponding supporting portions of the frame structure, the window elements decreasing in dimension, the smallest one being located at the lowermost position and the largest one being located at the uppermost position. The window elements are mutually spaced so that their marginal or peripheral regions are spaced a distance which is substantially the same as the distance between the respective central portions thereof.

In another embodiment of the invention, the frame structure comprises frame portions which are located between the marginal or peripheral edge support portions of pairs of vertically adjacent window elements so as to separate and support the same. These frame portions are adapted to separate the peripheral regions of the window elements at a distance which is substantially the same as the distance between the respective central portions of the window elements.

According to yet another embodiment of the invention, in order to space the marginal or peripheral regions of vertically adjacent window elements at a distance which is substantially the same as the respective central portions, the peripheral regions of the lower ones of the window elements include channel-shaped portions from which extend a preferably planar marginal flange. The channel-shaped portions fix the window elements at the desired relative locations. The planar marginal flanges of the various window elements overlie one another and are supported at the top surface of the skylight aperture forming edge surface structure.

In order to provide reliable support for the skylight apparatus as well as to insure against the passage of moisture through the skylight apparatus, it is desirable to provide a frame structure having a trough-like configuration located in the opening of the building which receives the skylight apparatus. In this arrangement, the frame structure constitutes a part of the thermal lagging for the marginal region of the skylight apparatus and, therefore, it has been found desirable and advantageous to provide spaces within the frame structure which can be filled with a thermal lagging compound. Such a trough-shaped frame structure which serves to support the various window elements can be provided with upwardly facing shoulders on its interior or, alternatively, may be formed having a continuous downward and inward slope. As mentioned above, such skylight apparatus is advantageously assembled at the manufacturing plant by mounting the marginal or peripheral support edge portions of the window elements on the supporting portion of the frame structure. Such mounting of the window elements can be accomplished using conventional means such, for example, as putty, glue, double-sided adhesive tapes or the like which, in addition to securing the window elements to the frame structure, also serves as a seal.

According to the present invention, the use of a separate frame structure enables the assembly of the skylight apparatus to take place in the manufacturing plant itself. Such a skylight apparatus comprises a tightly sealed window construction having a thermal insulating capacity, even at the marginal or peripheral areas of the window elements which is significantly improved relative to conventional skylight apparatus. Alternatively, the skylight apparatus of the present invention is particularly advantageous in that it may be installed directly at the building site in a rapid manner and without encountering any problems in connection with the formation of seals. As will be seen, the present invention also provides the advantage that the skylight apparatus does not require the manufacture and mounting of sheet metal flashing which, of course, is cumbersome.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DETAILED DESCRIPTION OF THE PREFERRED EMBODIMENT

Figure 1:
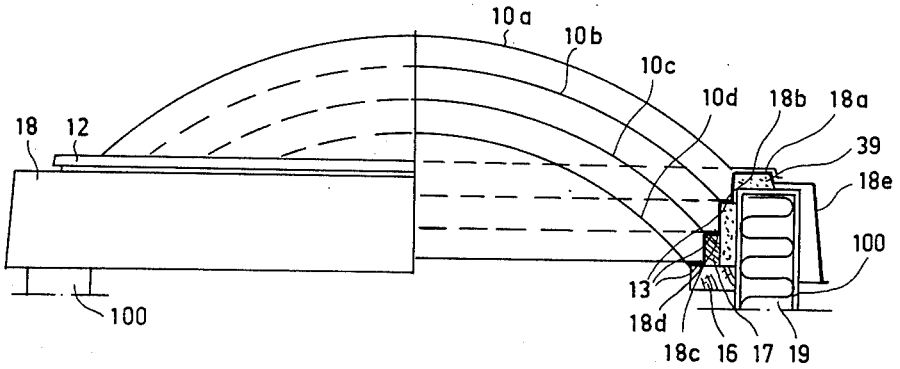
FIG. 1 is a schematic front elevational view in partial section of skylight apparatus constructed according to the present invention.

Referring now to the drawings wherein like reference characters designate identical or corresponding parts throughout the several views and, more particularly, to FIGS. 1–7, skylight apparatus according to the present invention is illustrated and comprises a set of window elements 10*a*, 10*b*, 10*c*, 10*d* and 11, each of which has an outer dimension which is different than the outer dimensions of the other of the window elements. The uppermost window element 10*a* thus has a larger outer diameter than any of the other window elements and comprises a dome-shaped central portion and a peripherally extending planar flange portion 12 which terminates in a downwardly extending rim portion 12*a*. As best seen in FIG. 1, the inner or lower window elements 10*b*, 10*c* and 10*d* are substantially similar in shape, the innermost or lowermost element 10*d* having the smallest outer diameter. The lowermost window element 10*d* (FIGS. 1, 3, 4, and 5) preferably has a rectangular outer configuration. It should also be understood that the window elements may have a circular, oval or other appropriate outer configuration.

The window elements are preferably formed of a suitable plastic material which is transparent to light, although in some cases it may be desirable to form the window elements of an opaque material.

Still referring to the embodiment of the invention illustrated in FIG. 1, the various window elements are supported at their marginal portions 12 by a step frame structure comprising supporting laths 16 and 17 upon which has been affixed a fluted, downwardly opening frame list 18 which defines a plurality of supporting steps or shoulders 18*b*, 18*c* and 18*d* which respectively carry the peripherally extending edge regions 13 of lower window elements 10*b*, 10*c* and 10*d* while the planar flange portion 12 of the uppermost window element 10*a* is carried by the upper shoulder 18*a* of the frame list 18. Further, the frame list 18 defines an outer, downwardly extending flange portion 18*e*. The entire window construction comprising the various window elements and the frame structure including the supporting laths and frame lists are mounted on the frame components 100 of the building, the latter comprising the edge surface structure which defines the skylight aperture in which the window construction is disposed. The building frame components 100 are provided with thermal lagging 19 as illustrated in FIG. 1. Further, the frame list 18 and building frame 100 define between them spaces 39 at the marginal regions of the window elements. These spaces 39 are filled with thermal insulating material such, for example, as by spraying foamed polyurethane into them in a manner known in the art. In this manner, good thermal as well as moisture insulation is obtained at the marginal edges of the window elements.

Figure 2:
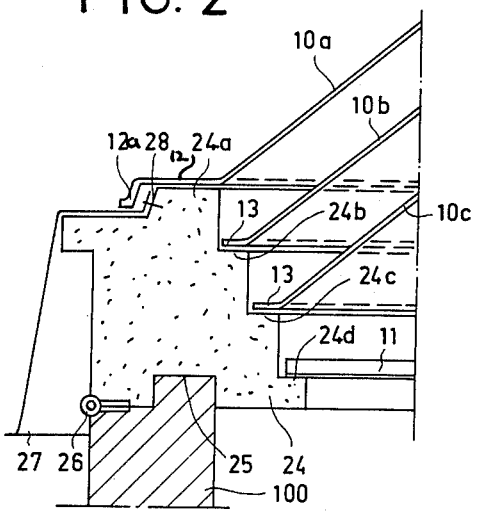
FIG. 2 is an elevation view in section of a portion of skylight apparatus constructed according to the present invention wherein the frame structure comprises a profiled member formed of a cellular resin.

Referring to FIG. 2, another embodiment for supporting the window elements is illustrated which includes frame structure comprising a molded member 24 of a cellular resin material such, for example, as foamed polyurethane. The molded member 24 comprising the frame structure can be formed of several straight pieces which are joined at their ends to form corners or, alternatively, may be formed as a unitary member in a single molding step. The frame component 24 when formed of foamed polyurethane has both a light weight due to the cellular nature of the material of which it is formed and, additionally, is provided with an impermeable external surface during the molding process. As shown in FIG. 2, the molded frame structure 25 defines an upwardly extending groove 24 formed in its lower surface which receives the aperture defining building frame component 100 which is part of the building. Further, the window construction in its entirety comprising the molded frame structure 24 and associated window elements are preferrably pivotally mounted on the building frame component 100 by means of a hinge 26 schematically illustrated in FIG. 2.

The inner surface of the molded frame component 24 defines a plurality of upwardly facing steps or shoulders 24*a*, 24*b*, 24*c* and 24*d*, which support the marginal edge regions 12, 13 of window elements 10*a*-10*c* in a manner similar to the construction discussed above relative to FIG. 1. The lowermost or innermost window element 11 which, according to the present invention, has the shortest transverse span, is planar, i.e., does not have a dome-shaped central portion, while the remaining window elements have a dome-shaped configuration. Thus, window elements 10*b* and 10*c* are substantially similar in configuration while terminating in the outer peripherally extending edge regions 13 while the uppermost or outermost window element 10*a* outwardly terminates with the flange 12 having the downwardly directed rim portion 12*a*. A protective metal sheet or skirt 27 extends over the outwardly facing side of the molded frame component 24 and is fixed in position by means of nails 28 or the like. The skylight apparatus constructed according to the embodiment of the invention illustrated in FIG. 2 has a significantly improved thermal insulating capacity especially at the marginal areas thereof which is vastly superior to that of known skylight constructions.

Figure 3:
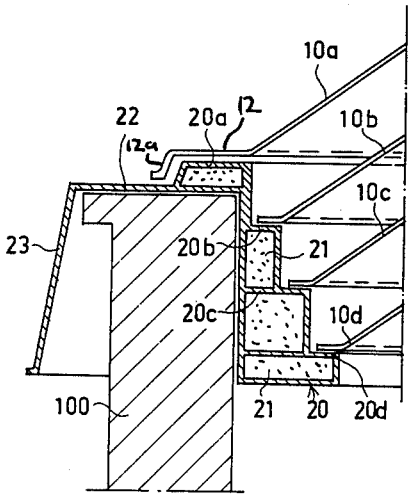
FIG. 3 is an elevation view in section of a portion of another embodiment of skylight apparatus according to the present invention wherein the frame structure pomprises a fluted metallic section having upwardly directed shoulders for supporting the window elements.

Referring now to FIG. 3 wherein the window construction utilizes yet another form of frame structure, the frame component comprises a metallic member 20 formed, for example, of aluminum. The metallic member 20 has a downwardly directed flange 23 defining its outer surface, a horizontally extending flange 22 and an inner side construction comprising inner steps or shoulders 20*a*, 20*b*, 20*c* and 20*d*, the inward extent of the shoulders 20 increasing in the downward direction. The outer flange 23, the horizontal flange 22 and the inner stepped construction define an area into which the building frame components 100 are received so that metallic frame structure 20 is supported thereon. In a manner similar to the embodiments of FIGS. 1 and 2, the peripherally extending edge regions 12, 13 of the window elements 10*a*-10*d* abut on the steps 20*a*–20*d*, respectively.

Figure 4:
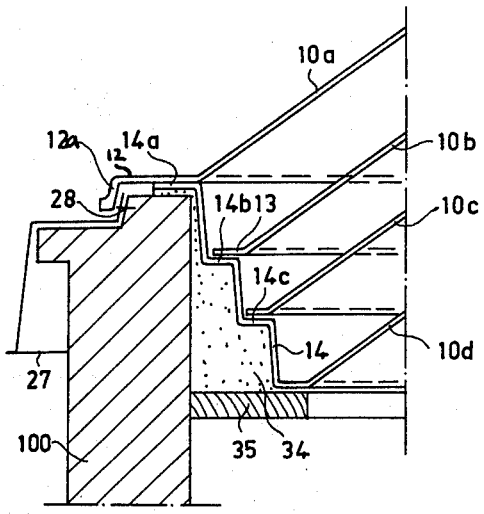
FIG. 4 is an elevation view in section of a portion of skylight apparatus according to another embodiment of the present invention wherein the lowermost window element comprises a unitary portion of the frame structure.

Referring now to FIG. 4, yet another window construction is illustrated. In this embodiment, the lowermost or innermost window element 10*d* is formed with an outer stepped portion which constitutes the supporting frame structure 14 for the window construction. Thus, supporting steps 14*a*, 14*b*, 14*c* are integrally formed and extend upwardly from the lowest window element 10*d*, the latter being the first window element installed in the aperture forming building frame component 100. The combined innermost window 10*d* and supporting frame structure 14 terminates at its outer end at a peripherally extending marginal flange 14*a*, the latter abutting against the upper surface of the building frame component 100. In this manner, a space 34 is defined between the building frame component 100 and the frame structure portion of window element 10*d* which is filled with a thermal insulating material such, for example, as foamed polyurethane or the like, the space 34 being closed at its lower end by a peripherally extending board 35. In a manner similar to the embodiment illustrated in FIG. 2, a protective metal skirt 27 is affixed such as by nailing 28 to the outer side of the building frame component 100.

Figure 5:
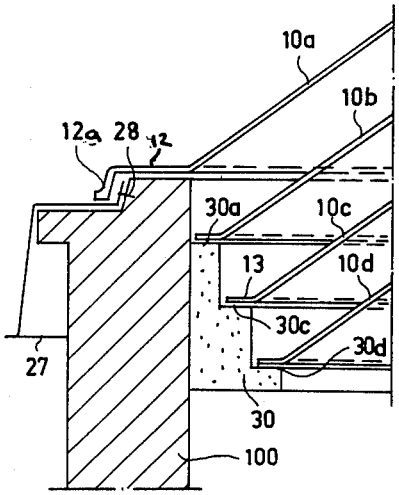
FIG. 5 is an elevational view in section of a portion of skylight apparatus of the present invention illustrating another type of frame structure.

In the embodiment illustrated in FIG. 5, the frame structure of the window construction comprises a member 30 formed of a cellular resin such, for example, as foamed polyurethane and defines inwardly directed supporting shoulders or steps 30*a*, 30*c* and 30*d* which extend inwardly for progressively increasing extents in the downward direction. The steps support the window elements in the same manner as in the previous embodiments, the peripherally extending edge regions 13 abutting the corresponding steps while the peripheral marginal flange 12 of the uppermost or outermost window element 10*a* abuts directly on the upper horizontal surface of the building frame component 100.

Figure 6:
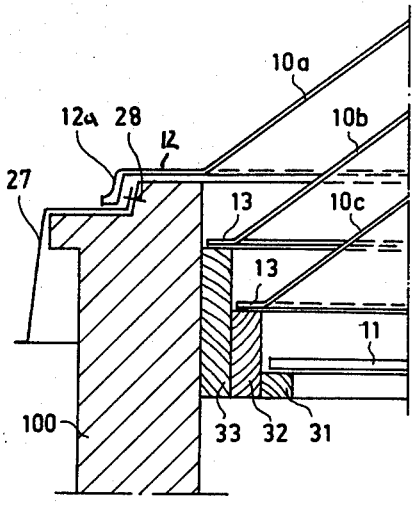
FIG. 6 is an elevation view in section of a portion of skylight apparatus according to the present invention illustrating yet another type of frame structure.

Referring now to FIG. 6, the frame structure of the window construction comprises three laths or timber strips 33, 32 and 31 of progressively decreasing heights which are mutually fastened together in side by side fashion so as to define upwardly directed inwardly extending steps for mounting the window elements in the same manner as discussed above in connection with the previously discussed embodiments. More particularly, the window elements 10*b* and 10*c* having the central dome-shaped configuration have their peripherally extending marginal edges 13 abutting on the inwardly directed shoulders or steps defined by the laths 33, 32, respectively. The lowermost window element comprising a planar window element 11 has its peripherally extending marginal edge region abutting on the inwardly directed shoulder defined by lath 31. The uppermost or outermost element 10*a* is mounted with its outwardly directed flange 12 resting directly upon the upper edge surface of the building frame component 100.

Thus, in the embodiments discussed above illustrated in FIGS. 1–6, the skylight apparatus of each embodiment includes a frame structure which defines a plurality of vertically spaced supporting portions extending around the inner periphery of the supporting structure. Each of the supporting portions comprises an upwardly facing inwardly directed step or shoulder, the inwardly directed extent of each of the shoulders increasing in the downward direction. In other words, each of the supporting steps or shoulders or the frame structure will have mutually opposed sections, i.e., sections which lie in the aperture defined by the building component 100 which face each other in opposed relationship. The distance between these opposed sections diminishes in the downwardly direction, i.e., opposed sections of the lowest supporting step or shoulder are closer to each other than the opposed sections of the next higher supporting step or shoulder. In a corresponding manner, the outer dimensions of the lower window elements is smaller than the outer dimension of the next higher window element, etc.

Figure 7:
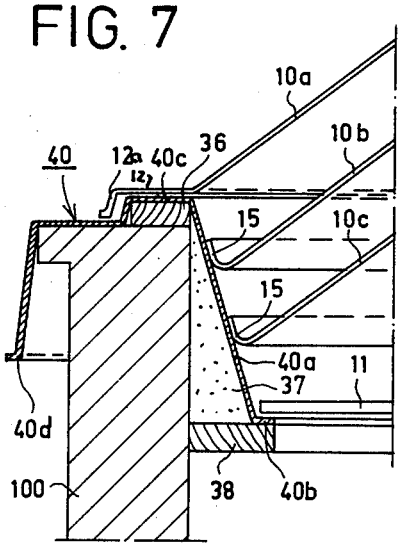
FIG. 7 is an elevation view in section of a portion of skylight apparatus according to the present invention wherein the frame structure decreases in dimension in the downward direction in a continuous manner.

Referring now to FIG. 7, the embodiment illustrated therein differs from the embodiments of FIGS. 1–6 in that the supporting surfaces of the frame structure of the window construction do not comprise inwardly directed steps or shoulders but, rather, the frame structure presents a surface which slopes downwardly and inwardly in a continuous manner thereby narrowing in the downward direction. More particularly, the frame structure comprises a metallic member 40 having an inner flange 40*a* which constitutes the continuously downwardly and inwardly sloping supporting member for the window elements 10*b*, 10*c*, a stepped, horizontally extending flange 40*c* and an outer, downwardly directed flange 40*d*. The building frame component 100 is received within the interior of the frame structure 40, a lath 36 being fixed on the upper surface of building frame component 100 as shown. The inner terminal edge of the sloping flange 40*a* has a peripherally extending horizontal flange 40*b* formed thereon which carries the lowermost planar window element 11 thereon.

The marginal portions 15 of the inner window elements 10*b* and 10*c* extend upwardly and outwardly at an angle which corresponds to the slope of the inner flange 40*a* of frame structure 40 so that a reliable support of these window elements by the frame structure 40 is achieved. The space 37 defined between the inner sloping flange 40*a* of the frame structure 40 and the inner surface of the building frame component 100 is filled with a thermal insulating material such, for example, as foamed polyurethane, the lower border of space 37 being closed by the edge board 38 as shown.

As is apparent from the embodiments of the invention described above relative to FIGS. 1–7, the skylight apparatus of the present invention comprises window elements having various sizes which are disposed one over the other and supported by downwardly narrowing supporting regions of frame components constructed in a variety of ways. In each case, the supporting portions of the frame structure of the skylight apparatus is such that the lowermost supporting portion supports a window element which is the smallest in size. In this manner, the skylight apparatus of the present invention is easy to assemble and disassemble and, furthermore, the spacing between the dome-shaped portions of vertically adjacent pairs of window elements are substantially equal to the spacing between the marginal regions thereof. This is important in that good thermal insulating capacity is obtained even in the marginal areas of the skylight apparatus. When the unitary frame structures illustrated in FIGS. 2, 3, 4, 5 and 7 are utilized, the skylight apparatus of the present invention can be completely assembled in the factory and mounted as a completed unit in the skylight aperture defined by the building frame component. In such cases, the final thermal lagging which also functions as means for preventing the formation of condensate, is advantageously provided by injecting a foamed plastic material into the spaces defined between the frame structure of the skylight apparatus and the building frame components of the building.

Figure 8:
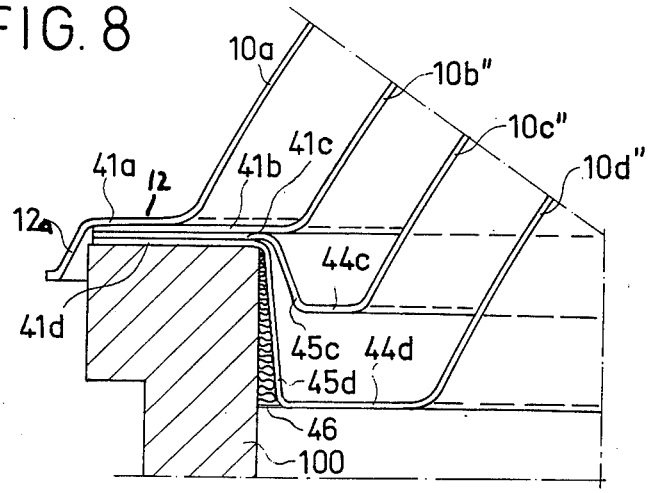
FIGS. 8–10 are elevation views in section of portions of skylight apparatus according to the present invention wherein at least some of the window elements include channel-shaped portions at their edge regions.
Figure 9:
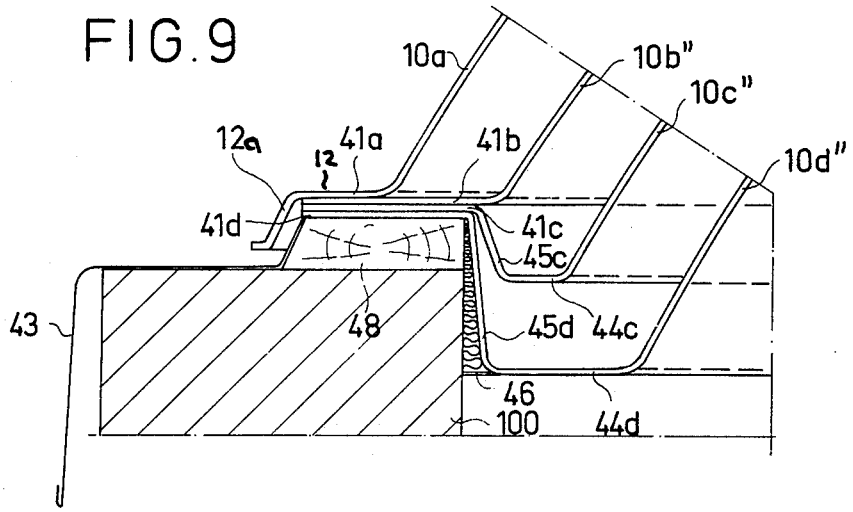
Figure 10:
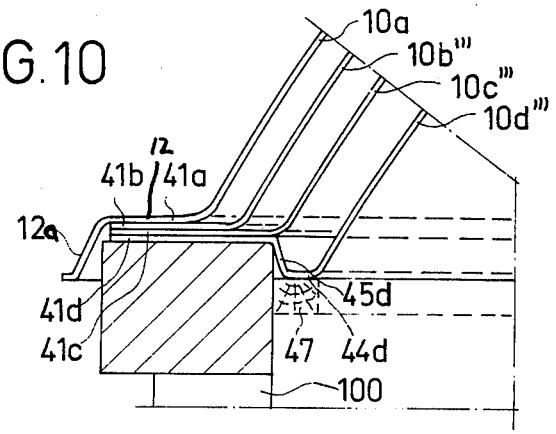

Referring now to the embodiments of the invention illustrated in FIGS. 8 & 10, the uppermost window element 10*a* is formed having a sufficiently large outer dimension at its peripherally extending marginal edge regions 12 so as to extend beyond the outer edge of the horizontal surface of the building frame component 100. The embodiment of the invention illustrated in FIG. 9 differs from this construction in that a supporting list 48 is affixed to the upper surface of the building frame component 100 at its inner edge region in a manner such that the peripherally extending marginal edge region or flange 12 of the topmost window element 10*a* extends beyond the list 48 with the downwardly extending rim 12*a* enveloping the latter. A sheet metal flashing 43 is affixed to the outer edge of the supporting list 40 and extends over the horizontal surface of building frame component 100 and has a skirt forming portion which extends downwardly at the outer surface thereof.

As illustrated in FIGS. 8–10, the lowermost or innermost window element 10*d*'' (FIGS. 8 and 9), 10*d*''' (FIG. 10) is formed having a channel-shaped peripherally extending portion which surrounds the central dome-shaped portion thereof which, as explained below, facilitates the mutual spacing of the window elements so that such spacing between vertically adjacent elements will be substantially the same in the marginal areas as at their central regions.

Referring to FIG. 10, the channel-shaped portion is provided only on the lowermost or innermost window element 10*d*''' and is defined by a horizontally extending web portion 44*d* which connects the lower edge of the dome-shaped portion of the window element with an upwardly extending flange portion 45*d*. Finally, a horizontally extending flange 41*d* is integrally formed with upwardly extending flange 45*d* and forms a continuation thereof, the flange 41*d* peripherally extending around the window element 10*d*''' so as to rest upon the upper surface of the building frame component 100. The central window elements 10*b*''' and 10*c*''' comprise dome-shaped central portions and outer, peripherally extending marginal flanges 41*b*, 41*c* which rest upon the flange 41*d*. Finally, the uppermost window element 10*a* has a peripherally extending marginal flange 12 which rests over flanges 41*d*, 41*c* and 41*b*, flange 12 terminating at a downwardly extending lip 12*a*. The overlying marginal flanges 41*a*–41*d* are preferably fixed to the building frame component 100 by conventional means, such as by screws.

Although the embodiment of the invention illustrated in FIG. 10 provides good thermal insulation capacity in the marginal regions of the skylight apparatus, the embodiments illustrated in FIGS. 8 and 9 are preferred in that the thermal insulation capacity provided thereby is somewhat better than in the design in FIG. 10, the latter being preferred when the thermal insulation capacity of the skylight apparatus is not required to meet the strictest requirements. Thus, referring to FIG. 8, the innermost window element 10*d*'' and the next vertically adjacent window element 10*c*''' are both formed with channel-shaped portions which adjoin the dome-shaped central portions thereof. The channel-shaped portion of the lowest or innermost window element 10*d*'' is both wider and deeper than the corresponding channel-shaped portion of window element 10*c*'', the web 44*d* of the former being longer than the web 44*c* of the latter and, correspondingly, the upwardly directed flange 45*d* of window element 10*d*'' being longer than the upwardly directed flange 45*c* of the next higher window element 10*c*''. In each case, outwardly directed peripherally extending marginal flanges 41*d* and 41*c* extend outwardly from the upper edge region of the upwardly directed flanges 45*d*, 45*c*. The embodiment of the invention illustrated in FIG. 9 is formed having similar structure as described above in connection with FIG. 8. In both the embodiments of FIGS. 8 and 9, thermal lagging is provided within the space defined between the upwardly directed flanges 45*d* and the inner surface of the building frame component 100, the thermal lagging preferably comprising a foamed plastic which is injected into this wedge-shaped space.

Referring again to FIG. 10, a list 47 is shown in phantom to indicate the fact that the same is not necessarily required insofar as the structural requirements of the skylight apparatus are concerned. More particularly, the list 47 is provided in abutted relationship with the lower surface of the web 44*d* for the primary purpose of serving as an ornamental molding and not for any supporting function since the dome-shaped window elements 10 of this embodiment are supported by the top surface of the building frame component 100 (FIGS. 8 and 10) or by the supporting lath 48 (FIG. 9). The fact that the window elements are supported by the upper surface of the building frame component eliminates the requirements for a supporting frame structure of the type illustrated in FIGS. 1–7, i.e., frame structure which provide downwardly narrowing supporting portions for the marginal edge regions of the window elements.

It should also be noted that in the embodiments of the invention illustrated in FIGS. 8–10 wherein window elements having a channel-shaped portion are utilized, the combined diameter of the dome-shaped portion and the channel-shaped portion of a window element is substantially the same as the diameter of the dome-shaped portion of the particular window element which is placed over the window element having the channel-shaped configuration.

In connection with the embodiments of the invention illustrated in FIGS. 8–10, it should be noted that skylight apparatus wherein two window elements having dome-shaped central portions and peripherally extending planar marginal portions are known wherein the window elements are supported by their marginal portions resting on the building frame component structure. Such window elements of the prior art are substantially equivalent to the window elements 10*a*, 10*b*'' and 10*b*''' depicted in FIGS. 8–10 with the main difference being that in such prior art window elements, the spacing between vertically adjacent window elements at their marginal regions are somewhat less than the spacing between the central dome-shaped regions of the window elements.

Thus, it is apparent from the above, that in connection with the embodiments of the invention illustrated in FIGS. 8–10, the spacing between vertically adjacent window elements at their marginal edge regions are substantially the same as the spacing between the central dome-shaped portions of the window elements. In this manner, thermal and moisture insulation is significantly improved relative to prior art apparatus. This is accomplished by providing downwardly directed channel-shaped portions for those window elements whose dome-shaped central portions terminate at a height below the supporting surface of the building frame component. Thus, the window elements 10*c*'', 10*d*'' (FIGS. 8 and 9) and window element 10*d*''' (FIG. 10), all of whose dome-shaped central portions terminate below the level of the supporting surface of the building frame component 100, are provided with the channel-shaped portions so as to achieve the desired mutual spacing between the marginal areas of the window element and the next vertically adjacent window element.

Figure 12:
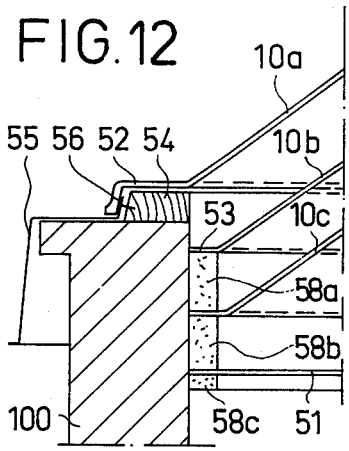
FIG. 12 is a schematic elevation view in section of a portion of yet another embodiment of the skylight apparatus of the present invention.
Figure 13:
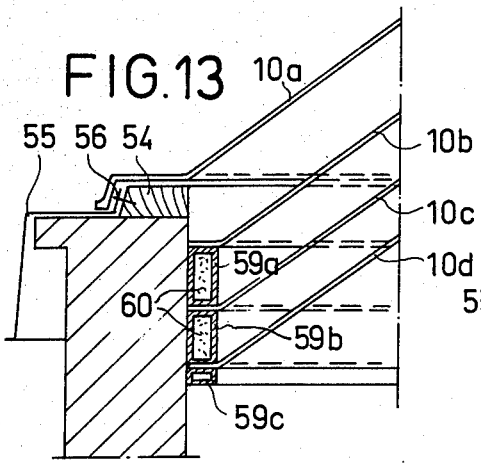
FIG. 13 is an elevation view in section of a portion of yet another embodiment of skylight apparatus according to the present invention wherein the lower window elements are supported and mutually separated by means of frame components made of profiled metal sections.
Figure 14:
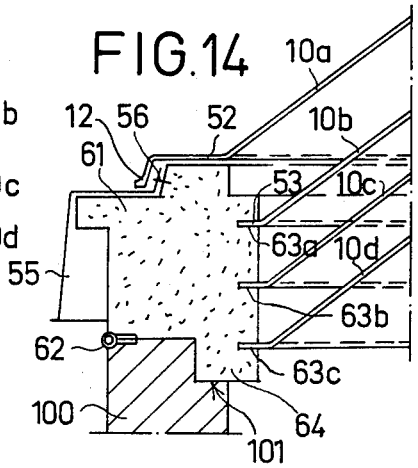
FIG. 14 is an elevation view in section of a portion of another embodiment of skylight apparatus according to the present invention in which the frame structure comprises profiled members formed of cellular resins.

Turning to FIGS. 11–16, embodiments of the present invention are illustrated wherein all of the inner window elements, i.e., all of the window elements except the topmost or outer window 10*a*, have substantially the same outer diameter, the dome-shaped window elements having substantially the same configuration. Referring first to FIG. 14, the frame structure of the present invention comprises a molded member 61 which, as is the case in connection with all of the frame structures described above, extends around the outer periphery of the skylight aperture defined by the building components 100. The frame structure may be provided in several interconnected pieces or may be integrally formed as a unitary member during the casting process. Thus, frame structure 61 is preferably formed of plastic material such, for example, as foamed polyurethane and is located over the top surface of the building frame component 100 by means of a cooperating groove-tongue arrangement 64, 101. Thus, the frame structure 61 may be assembled from straight sections interconnected at their ends with mitered joints to form corners. The lower window elements 10*b*, 10*c* and 10*d* have dome-shaped central regions and peripherally extending marginal portions 53, the latter of which are received within corresponding peripherally extending grooves 63*a*, 63*b* and 63*c*, respectively, formed in the inner sides of the frame structure 61. In this manner, a unitary skylight apparatus comprising the window elements 10*b*, 10*c* and 10*d* and the frame structure 61 may be completed at the factory and installed in the skylight aperture defined by the building frame components 100. The topmost window element 10*a* is larger than the lower window elements and can be mounted to the frame structure 61 either at the factory during assembly of the window construction or, alternatively, can be mounted after the installation of the skylight apparatus within the skylight aperture. The entire window construction comprising the frame structure 61 and associated window elements 10 is preferably mounted within the skylight aperture by means of hinge pin 62 so as to be pivotally movable with respect to the building frame component 100.

Figure 15:
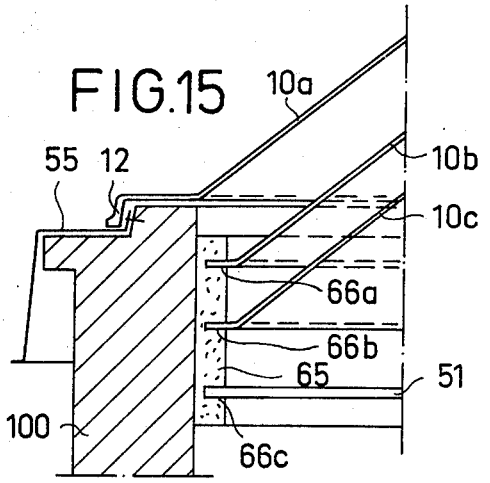
FIG. 15 is an elevation view in section of a portion of skylight apparatus according to the present invention wherein the lower window elements are affixed in the aperture by means of frame portions formed of cellular resins.
Figure 16:
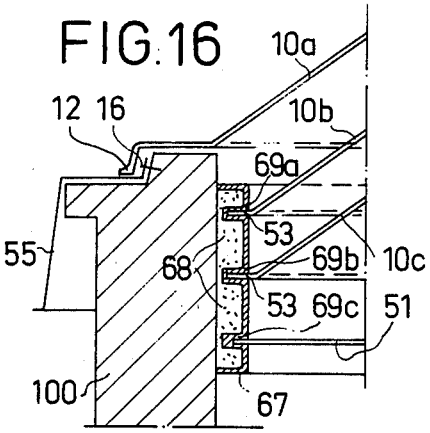
FIG. 16 is an elevation view in section of a portion of skylight apparatus according to yet another embodiment of the invention wherein the frame portions of FIG. 15 are replaced by profiled metal sections.

Referring now to FIGS. 15 and 16, in lieu of a frame structure which is mounted on top of the building frame component 100 as illustrated in FIG. 14, frame structure is affixed to the inner aperture defining surface of the building frame component 100. More particularly, one-piece lists 65 and 67 are provided in the embodiments illustrated in FIGS. 15 and 16, respectively, which are affixed to the inner aperture defining surface of the building frame component 100. The window elements 10*b*, 10*c* and 51 are attached by their respective peripherally extending marginal edge regions 53 in grooves which are preformed in the lists prior to the window elements being installed. As illustrated in FIG. 15, the frame structure 65 preferably comprises four straight sectional parts 65 formed of pressed material, such as polyurethane, which are mutually joined at their ends by mitered joints during installation of the window elements 10*b*, 10*c* and 51. In a similar manner, in connection with the embodiment illustrated in FIG. 16, the same structure comprises metallic sections 67 having grooves formed therein for receiving the edges 53 of the window elements 10*b*, 10*c* and 51. The spaces defined between the interior of the metallic section 67 and the inner wall of the building frame component 100 are preferably filled with a thermal insulating material such as foamed polyurethane or the like.

Thus, the embodiments of the invention illustrated in FIGS. 14–16 are similar in that the lower window elements have their peripherally extending marginal edge areas received within grooves formed in the frame structure of the window construction. Although such assembly may be accomplished at the site of installation, it is preferred that such assembly be performed at the factory so that adverse weather conditions will not materially affect the installation.

In fact, the various window constructions illustrated in FIGS. 10–16 may be assembled and installed in a variety of ways. For example, the skylight apparatus illustrated in FIG. 14 is preferably preassembled at the factory and then mounted over the skylight aperture defining building frame component 100. The uppermost window element 10*a* is then preferably mounted at its appropriate location either subsequent to the installation of the window construction in the skylight aperture or at the factory prior to this operation.

Figure 11:
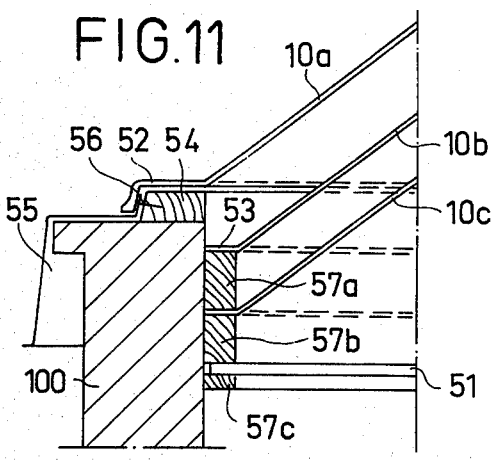
FIG. 11 is an elevation view in section of a skylight apparatus according to the present invention illustrating yet another embodiment thereof.

Referring to FIGS. 11–13, the frame structure for supporting the window elements of the skylight apparatus, rather than having grooves defined on the inner surface of unitary sections, comprise a lower frame part 57*c*, 58*c*, 59*c*, an upper frame part 57*a*, 58*a* and 59*a*, and an intermediate frame part 57*b*, 58*b* and 59*b*, respectively. Thus, in the embodiments illustrated in FIGS. 11–13, the lowermost frame parts 57*c*, 58*c*, and 59*c* are first installed and affixed to the inner surface of building frame component 100 whereupon either a planar window element 51 (FIGS. 11, 12) or a dome-shaped window element 10*d* (FIG. 13) is located within the skylight aperture so that its marginal edge regions rest upon the lowermost frame parts. Subsequently, the intermediate frame parts 57*b*, 58*b*, 59*b* (FIGS. 11, 12 and 13, respectively) are fixed over the edge regions of the previously installed window elements, whereupon the window element 10*c* is located in the skylight aperture so that its marginal regions rest upon the top surface of the intermediate frame parts. The upper frame parts 57*a*, 58*a* and 59*a* are then installed thereover. The window element 10*b* is then installed so that its marginal edge region 53 rests over the top surface of the top frame section. The topmost window element 10*a* is then fixed in place using a lath 54 provided at the inner region of the upper surface of the building frame component 100, the peripherally extending flange 52 resting thereon. A sheet metal flashing 55 is attached by conventional means, such as by nails 56 to the lath 54. In order to more securely mount the window elements to the associated frame structure in the embodiments of FIGS. 11–13, a double-sided adhesive tape, putty, glue or other equivalent means may be utilized which also advantageously serves to seal the window construction against the passage of moisture. It should also be noted that in some cases it is possible to install the window elements from the underside so that the uppermost or top window element 10*a* is first installed and, thereafter, the lower window elements are installed in succession.

In the embodiment of the invention illustrated in FIGS. 11, 12, 15 and 16, the skylight apparatus includes two inner dome-shaped window elements 10*b* and 10*c* which are substantially of the same size and configuration and which are so fixed that their mutual spacing from each other is the same at every point. In the embodiments of the invention illustrated in FIGS. 13 and 14 wherein the skylight apparatus comprises three inner dome-shaped window elements 10*b*, 10*c* and 10*d*, these windows elements are also of equal size and shape and are spaced from each other at equal distances at all points. These inner dome-shaped window elements have peripherally extending marginal edge portions 53 which lie in a single plane and by which the window elements 10*b*, 10*c*, and 10*d* are mounted in conjunction with the associated frame structure to form the skylight apparatus of the present invention.

Returning now to the embodiments of the invention illustrated in FIGS. 8–10, the invention presents an advantageous means by which existing conventional skylight apparatus can be modified so as to improve the thermal insulating capacity thereof. More particularly, the existing dome-shaped window elements which correspond to the dome-shaped elements 10*a*, 10*b*″ (FIGS. 8 and 9) and 10*b*‴ (FIG. 10) which, as indicated above, are known in the prior art, are not discarded upon the installation of the skylight apparatus according to the present invention, but are retained. However, the thermal insulating capacity thereof is significantly improved by adding the additional window elements having the channel-shaped portions described above at a location below the existing dome-shaped window elements. More particularly, these additional elements have a configuration similar to the window elements 10*c*″ and 10*c*″ (FIGS. 8 and 9) and/or 10*d*‴ (FIG. 10) illustrated in FIGS. 8–10, each of which includes the channel-shaped marginal portions described above. The installation of such additional window elements can be accomplished in an efficient and swift manner and requires no substantial alteration of the aperture defining building frame components. However, such additions significantly improve the thermal insulation capacity of the skylight apparatus by virtue of maintaining the spacing at the marginal regions of the window elements substantially the same as the distance between the dome-shaped central portions thereof.

Returning now to the embodiments of the invention illustrated in FIGS. 11–16, the inner window elements 10*b*, 10*c*, 10*d* and 51 are each supported by means of the frame structure which locate the inner window elements in a manner such that the distance between vertically adjacent window elements at their marginal regions is substantially the same as the distance between the corresponding central regions thereof so that a thermal insulation which is essentially as good as that which exists in the central regions of the window construction is obtained at the marginal regions. In the embodiment of the invention illustrated in FIG. 11, the frame structure comprises strips 57*a*, 57*b* and 57*c* which are affixed to the inner side of the aperture defining building frame component, with the margins 53 of the window element 10*b* being supported on the top of the upper edge of the upper strip 57*a* and the corresponding margins of the window elements 10*c* and 51 being fixed between the respective strips. As illustrated in FIG. 12, the corresponding frame structure comprises strips 58*a*, 58*b* and 58*c* which are preferably molded of plastic such, for example, as foamed polyurethane having a cellular interior and whose outer surface is provided with a tight sealed nature during the casting process. The corresponding frame of the embodiment illustrated in FIG. 13 comprises metallic sections 59*a*, 59*b* and 59*c* formed, for example, of aluminum and having interior hollow spaces 16 filled with an insulating material such, for example as foamed polyurethane or the like.

Where existing skylight apparatus is desired to be modified or renovated, the topmost window element 10*a* (FIGS. 10–16) may be replaced by the existing window element which is retained in place with the additional skylight structure being provided from below, i.e., the additional window elements 10*b*, 10*c*, 10*d* and/or 51 may be provided with the upper window element in place. Alternatively, the existing topmost window element which corresponds to the upper window element 10*a* of the present invention, may be removed with the additional window elements being installed from the top in the manner described above and, finally, a new skylight element 10*a* may be provided or the old one retained in its place.

The embodiments of the skylight apparatus illustrated in FIGS. 15 and 16 are preferably assembled in the factory with the window elements 10*b*, 10*c* and 51 having their marginal edge regions affixed in the grooves of the frame structures 65, 67. In this manner, the assembled window construction can be inserted from above or below into the skylight aperture with the frame structures affixed in any suitable manner to the inner walls of the building frame components 100. The topmost window element 10*a* may be positioned prior to such installation or subsequent thereto.

Obviously, numerous modifications and variations of the present invention are possible in the light of the above teachings. It is therefore to be understood that within the scope of the appended claims, the invention may be practiced otherwise than is specifically disclosed therein.

What is claimed is:

1. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a manner such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means including a frame structure defining a plurality of vertically spaced supporting portions, each of said supporting portions extending around the inner periphery of said supporting structure and wherein each of said plurality of supporting portions extends inwardly to a greater extent than the supporting portion located immediately thereabove, said supporting portions comprising surfaces which slope downwardly and inwardly and wherein said peripheral edge support portions of said window elements extend continuously upwardly and outwardly at a slope which substantially corresponds to the slope of said frame supporting portions, and wherein a plurality of said vertically spaced window elements are provided, each having a dimension which varies with respect to the other of said window elements, said window elements being mounted at their peripheral edge support portions on corresponding supporting portions of said frame structure with the smallest window element being the lowest of said window elements and the largest window element being uppermost, and wherein said frame structure is adapted to be mounted on said skylight aperture forming building frame component.

2. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a manner such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means including a frame structure defining a plurality of vertically spaced supporting portions, each of said supporting portions extending around the inner periphery of said supporting structure and wherein each of said plurality of supporting portions extends inwardly to a greater extent than the supporting portion located immediately thereabove, and wherein a plurality of said vertically spaced window elements are provided, each having a dimension which varies with respect to the other of said window elements, said window elements being mounted at their peripheral edge support portions on corresponding supporting portions of said frame structure with the smallest window element being the lowest of said window elements and the largest window element being uppermost and wherein said frame structure is adapted to be mounted on said skylight aperture forming building frame component so that a space is defined upon mounting said frame structure on said skylight aperture, said space being filled with a thermal insulating material.

3. Skylight apparatus as recited in claim 2 wherein said thermal insulating material comprises foamed polyurethane.

4. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a manner such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means including a frame structure defining a plurality of vertically spaced supporting portions, each of said supporting portions extending around the inner periphery of said supporting structure and wherein each of said plurality of supporting portions extends inwardly to a greater extent than the supporting portion located immediately thereabove, said frame structure further comprising an open ended troughshaped member having a decreasing dimension in the downward direction and an outwardly directed peripherally extending flange formed at its upper edge region, said supporting portions being formed in the interior thereof, and wherein a plurality of said vertically spaced window elements are provided, each having a dimension which varies with respect to the other of said window elements, said window elements being mounted at their peripheral edge support portions on corresponding supporting portions of said frame structure with the smallest window element being the lowest of said window elements and the largest window element being uppermost, and wherein said frame structure is adapted to be mounted on said skylight aperture forming building frame component.

5. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a manner such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means including a frame structure formed unitarily with the lowermost window element defining a plurality of vertically spaced supporting portions, each of said supporting portions extending around the inner periphery of said supporting structure and wherein each of said plurality of supporting portions extends inwardly to a greater extent than the supporting portion located immediately thereabove, and wherein a plurality of said vertically spaced window elements are provided, each having a dimension which varies with respect to the other of said window elements, said window elements being mounted at their peripheral edge support portions on corresponding supporting portions of said frame structure with the smallest window element being the lowest of said window elements and the largest window element being uppermost, and wherein said frame structure is adapted to be mounted on said skylight aperture forming building frame component.

6. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a manner such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means comprising peripheral edge regions of at least one of the lower ones of said window elements which include a channel-shaped portion terminating in an outer substantially planar marginal flange, said window elements being arranged such that said marginal flanges of respective window elements overlie one upon the other to fix said window elements in place, said overlying flanges being supported by said aperture forming building frame component.

7. Skylight apparatus as recited in claim 4 wherein said channel-shaped portion is defined by a substantially planar web portion adjoining the dome-shaped portion of said window element and an upwardly extending flange portion, said marginal flange integrally extending from said upwardly extending flange portion at a substantial angle thereto.

8. Skylight apparatus as recited in claim 4 wherein with respect to those window elements having said channel-shaped portions, the combined diameter of said dome-shaped and channel-shaped portions of a window element substantially equal the diameter of the dome-shaped portion of the window element which vertically overlies the same.

9. Skylight apparatus as recited in claim 4 wherein at least two of said window elements comprise only dome-shaped portions and peripherally extending marginal flanges and at least one of said window elements comprise dome-shaped portions having peripherally extending channel-shaped portions which terminate at outer planar marginal flanges, said window elements provided with channel-shaped portions being located below said window elements which do not include said channel-shaped portions so that the thermal insulation capacity of the latter is improved.

10. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a matter such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means comprising frame structure including frame portions mounted between the support edge portions of vertically adjacent window elements so as to separate and support said window elements so that the spacing between the regions adjacent to the peripherally extending outer support edge portions and the central portions of vertically adjacent window elements are maintained substantially equal, said frame portions comprising strips affixed in vertical relationship to said aperture forming building frame component, said outer support edge portions of said window elements being fixed between vertically adjacent strips.

11. Skylight apparatus as recited in claim 10 wherein said strips are formed of one of wood, plastic and metal.

12. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a manner such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means comprising frame structure including frame portions mounted between the support edge portions of vertically adjacent window elements so as to separate and support said window elements so that the spacing between the regions adjacent to the peripherally extending outer support edge regions and the central portions of vertically adjacent window elements are maintained substantially equal, said frame portions being defined by a profiled frame member formed of cellular resin and wherein said lower window elements are fixed at their outer support edge portions in internal grooves formed in said frame member, the latter being disposed on said aperture forming building frame component.

13. Skylight apparatus as recited in claim 12 wherein said cellular resin comprises polyurethane.

14. Skylight apparatus adapted to be located within a skylight aperture defined by aperture forming building frame components, comprising:

at least two dome-shaped light-transmitting window elements having outer dimensions which vary with respect to each other defining larger and smaller window elements, each of said window elements including peripherally extending outer support edge portions, said window elements being mounted in vertically spaced relationship one above the other at their respective peripheral support edge portions with the largest of said window elements being located at the uppermost position; and means for mounting said window elements in a manner such that the mutual spacing between regions adjacent to said peripherally extending outer support edge portions of vertically adjacent window elements are substantially equal to the mutual spacing between the central portions thereof and such that the spacing between at least the lowermost window element and the next vertically adjacent window element is located within the skylight aperture forming building component, said mounting means comprising frame structure including frame portions mounted between the support edge regions of vertically adjacent window elements so as to separate and support said window elements so that the spacing between the regions adjacent to the peripherally extending outer support edge regions and the central portions of vertically adjacent window elements are maintained substantially equal, said frame portions being defined by a continuous frame member having interior grooves formed therein and wherein lower window elements are fixed at their outer support edge portions in said grooves, said frame member being affixed to said aperture forming building frame component and said uppermost window element being fixed to said building frame component.

* * * * *